US006499897B2

(12) United States Patent
Yamamoto

(10) Patent No.: US 6,499,897 B2
(45) Date of Patent: Dec. 31, 2002

(54) CONTAINER FOR STICK TYPE COSMETIC MATERIAL

(75) Inventor: Wataru Yamamoto, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/139,345

(22) Filed: May 7, 2002

(65) Prior Publication Data

US 2002/0168213 A1 Nov. 14, 2002

(30) Foreign Application Priority Data

May 14, 2001 (JP) ..... 2001-143614

(51) Int. Cl.[7] ..... A45D 40/04; A45D 40/06; B43K 21/08

(52) U.S. Cl. ..... 401/68; 401/70; 401/75; 401/78; 401/79; 401/87; 401/88

(58) Field of Search ..... 401/64, 68–71, 401/75, 77, 76, 78, 79, 80, 86, 87, 88, 92, 93, 95

(56) References Cited

U.S. PATENT DOCUMENTS 5,407,286 A * 4/1995 Powers ..... 401/68

6,309,121 B1 * 10/2001 Ohba ..... 401/75

* cited by examiner

*Primary Examiner*—Timothy L. Maust
*Assistant Examiner*—Tuan Nguyen
(74) *Attorney, Agent, or Firm*—Rabin & Berdo, PC

(57) ABSTRACT

A travelling section 30 for retaining the stick type cosmetic material is installed rotatably in an axial direction in an outer shell section 2 which is constituted by rotatably connecting a front cylinder 10 and a base cylinder 20. An outer circumferential surface 43 of a spiral cylinder 40 which is spirally engaged with a male screw section of the travelling section fits in a second slide surface provided on an inner circumferential surface of the base cylinder 20 which is one component of the outer shell section 2. Due to frictional force of this fit-in part, a cylindrical body and the spiral cylinder 40 are synchronously rotated. The travelling section 30 is engaged with an inner circumference of the front cylinder 10 and can slide only in an axial direction. When the travelling section 30 reaches the uppermost limit or the lowermost limit by relative rotations of the front cylinder 10 and the base cylinder 20, if further rotary torque is furnished, synchronously rotating means are released and the base cylinder 20 and the spiral cylinder 40 are raced.

6 Claims, 13 Drawing Sheets

CONTAINER FOR STICK TYPE COSMETIC MATERIAL

BACKGROUND OF THE INVENTION

1. Field of the Invention

The present invention relates to a container for housing a stick type cosmetic material, more precisely an improvement of a mechanism for preventing a stick type cosmetic material feeding mechanism from breaking.

2. Description of the Related Art

A container for a stick type cosmetic material capable of housing the stick type cosmetic material in the container or feeding out the stick type cosmetic material by relatively rotating members which constitute the container and operating a feeding mechanism in the container has been known.

If the rotation is further continued at the uppermost limit or the lowermost limit of the stick type cosmetic material, a large load will be applied to the feeding mechanism and it will be possible for the container to be broken.

As measures for the problem described above, there has been a proposal which if rotary torque is furnished despite that the stick type cosmetic material reaches the uppermost limit, the further feeding operation will be stopped when a male screw of the feeding mechanism goes over the last thread ridge of a female screw. However, when the male screw goes over the last thread ridge of the female screw, the male screw falls once and is engaged with a next thread ridge and therefore a reciprocating motion is made at a short pitch at the uppermost limit

SUMMARY OF THE INVENTION

An object of the present invention is to prevent a feeding mechanism from breaking even though large rotary torque is furnished at the uppermost limit or the lowermost limit of a stick type cosmetic material.

Further, another object of the present invention is that even though large rotary torque is furnished at the uppermost limit of the stick type cosmetic material, the feeding mechanism does not make a reciprocating motion and therefore an up-and-down motion of the stick type cosmetic material can be minimized.

In order to achieve the objects described above, a container for a stick type cosmetic material which has a mechanism for feeding out the stick type cosmetic material according to the present invention comprises:

a front cylinder;

a base cylinder which can be connected to the front cylinder;

an outer shell section constituted by coaxially and rotatably connecting the front cylinder and the base cylinder;

a travelling section which is installed in the outer shell section, has a retaining section for retaining the stick type cosmetic material, and travels in an axial direction in the outer shell section;

a rotation regulating mechanism which allows the travelling section only to relatively slide in a axial direction with respect to one of the front cylinder and the base cylinder which constitute the outer shell section;

a spiral cylinder which has a female screw section to be spirally engaged with a male screw section installed at the travelling section;

a spiral engagement mechanism constituted by spiral engagement of the male screw section and the female screw section;

synchronously rotating means for rotating, by slide resistance, the spiral cylinder synchronously with the other one of the front cylinder and the base cylinder which constitute the outer shell section; and travel regulating means for regulating travel of the travelling section at the travelling limit in the outer shell section. And if the front cylinder and the base cylinder are relatively rotated, the travelling section will be fed out by the feeding mechanism, and if rotary torque which relatively rotates the front cylinder and the base cylinder exceeds a value of the slide resistance of the synchronously rotating means when the travelling section reaches the uppermost limit, the synchronously rotating means will be released and the spiral cylinder and the male screw section are synchronously rotated.

DESCRIPTION OF THE PREFERRED EMBODIMENTS

An embodiment of the present invention will subsequently be described with reference to the accompanying drawings.

Figure 1:
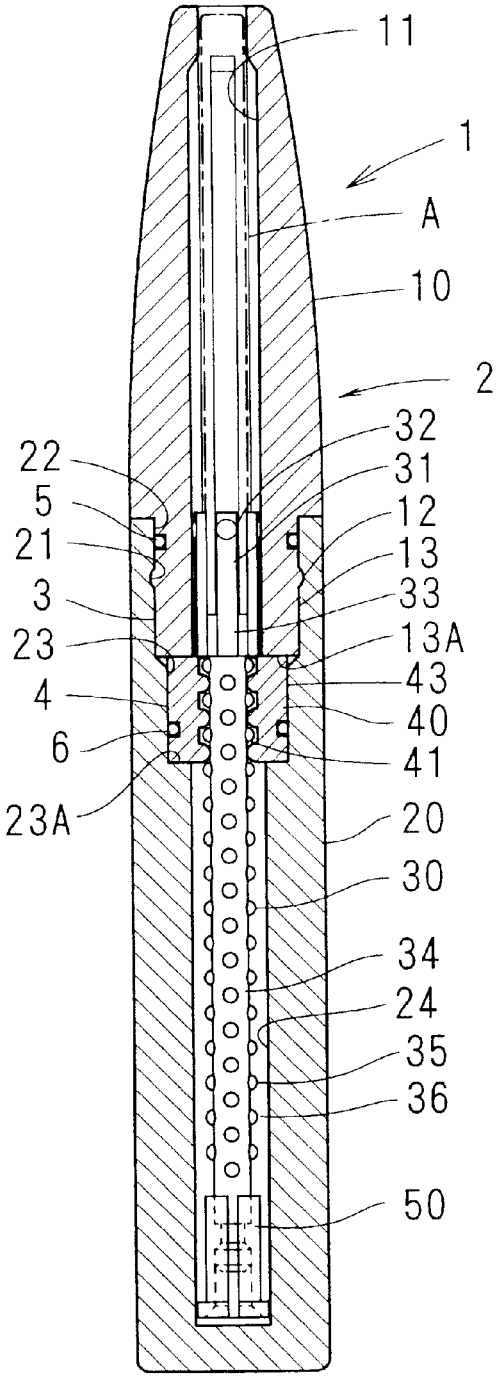
FIG. 1 is a sectional view showing a first embodiment of the present invention.
Figure 2:
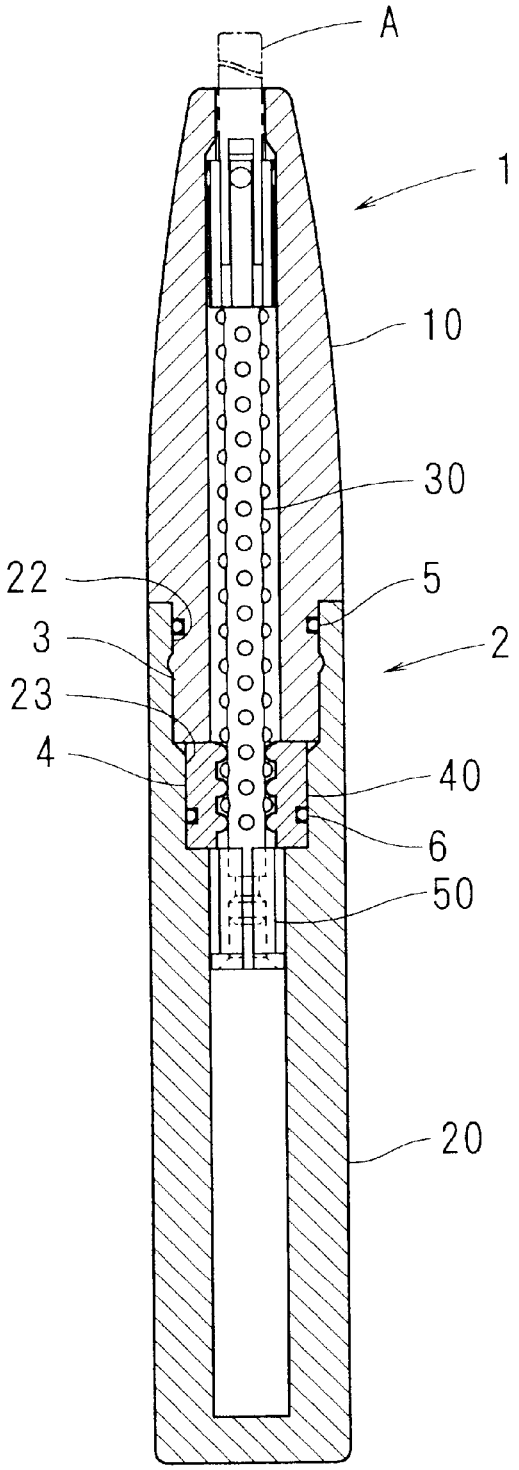
FIG. 2 is a sectional view showing the operating state, similarly.
Figure 3A:
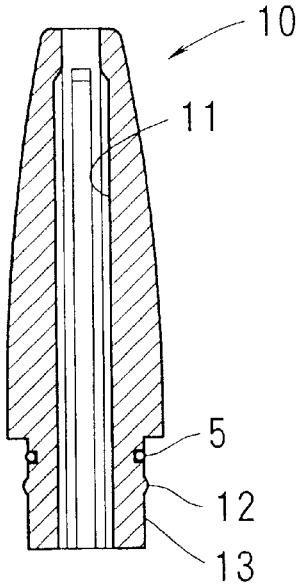
FIGS. 3A, B and C are exploded sectional views showing the first embodiment, similarly.
Figure 3B:
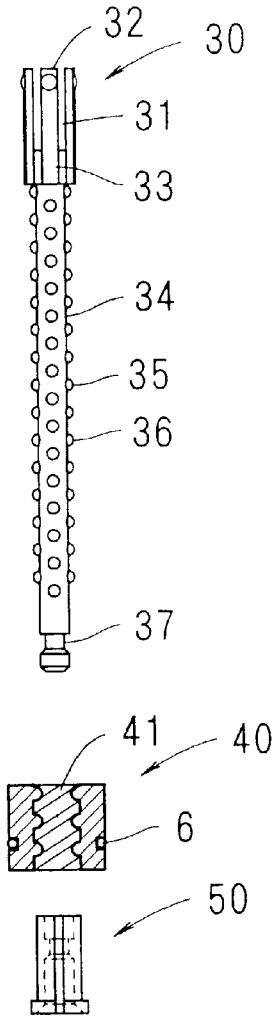
Figure 3C:
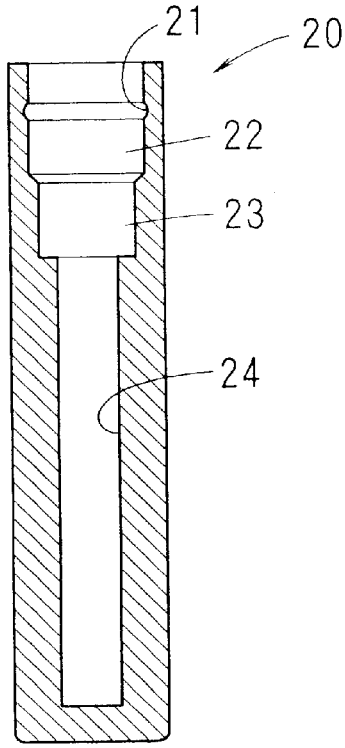

FIGS. 1 through 3 show a container for a stick type cosmetic material according to a first embodiment of the present invention.

As shown in the drawings, a container for a stick type cosmetic material 1 comprises a front cylinder 10, a base cylinder 20, a spiral cylinder 40, a push rod 30, and a stopper member 50.

The front cylinder 10 and the base cylinder 20 are coaxially connected around an axis of the container for a stick type cosmetic material 1 in such a manner that the front cylinder 10 and the base cylinder 20 can relatively rotate. An outer shell section 2 is constituted by the front cylinder 10 and the base cylinder 20, and a rotation regulating mechanism and a spiral engagement mechanism which will be described later are housed in the outer shell section 2.

An axis insertion section 13 is formed at a lower part of the front cylinder. Further, an axis hole 24 of the base cylinder 20 changes its inside diameter in consecutive order and by stages and the axis insertion section 13 is inserted in a part the inside diameter of which is the largest in the axis hole 24. An annular engagement convex section 12 is formed at an outer circumference of the axis insertion section 13. Further, an annular concave section 21 is formed on a first slide surface 22 which is an inner circumferential surface of an upper part of the axis hole 24 and the engagement convex section 12 is engaged with the concave section 21, thereby constituting a loose stop of the front cylinder 10 and the base cylinder 20.

In this embodiment, an O-ring 5 which is located above the annular engagement convex section 12 is put in the axis insertion section 13 of the front cylinder 10, thereby constituting a first slide section which gives appropriate slide resistance when the front cylinder 10 and the base cylinder 20 are relatively rotated.

Further, a second slide surface 23 which is located below the first slide surface 22 and has an inside diameter which differs from that of the first slide surface 22 is formed at an inner circumference of the axis hole 24 of the base cylinder 20. The spiral cylinder 40 is inserted in an area of the second slide surface 23 and the spiral cylinder 40 is sandwiched between an insertion front end 13A of the front cylinder 10 and a step section 23A of the second slide surface 23, whereby travel of the spiral cylinder 40 in an axial direction is regulated.

The push rod 30 constitutes a travelling section for moving a stick type cosmetic material A in an axial direction in the outer shell section 2.

At a tip of the push rod 30, a retaining section 31 which has a plurality of claws 32 for retaining the stick type cosmetic material A is formed. At a part in a shape of flange which is a lower end of the retaining section 31 and which is an extension line of each of the claws 32, each of claw base sections 33 is formed. Each of the claw base sections 33 is engaged, in such a manner that each of the claw base sections 33 cannot rotate and can slide, with a plurality of slide grooves 11 which are formed on an inner circumferential surface of the front cylinder 10 and extend in an axial direction, thereby constituting the rotation regulating mechanism between the push rod 30 and the front cylinder 10.

An axis section 34 which extends downward from the retaining section 31 of the push rod 30 is located in the axis hole 24 of the base cylinder 20 and a male screw section 36 composed of a lot of projections 35 is formed at an outer circumference of the axis section 34. The male screw section 36 is spirally engaged with a female screw section 41 which is formed at an inner circumference of the spiral cylinder 40, thereby constituting a spiral engagement mechanism.

The lots of projections 35 are arranged along a spiral line of male screws and, in this embodiment, these projections 35 stand in a line, at regular intervals, in an axial direction, at a location which covers a quarter of the outer circumference of the axis section 34, and at a cross section which is perpendicular to an axis line.

Incidentally, these projections 35 advance into the slide grooves 11, respectively, when the push rod 30 goes up. Therefore, the push rod 30 rises or descends along the male screw section 41 of the spiral cylinder 40 by rotating synchronously with the front cylinder 10.

It is arranged such that an O-ring 6 is installed on an outer circumferential surface of the spiral cylinder 40 and the O-ring 6 generates frictional force between the spiral cylinder 40 and the second slide surface 23, and the O-ring 6 keeps the spiral cylinder 40 in a stationary state when the push rod 30 is rotated. The area between the outer circumferential surface of the spiral cylinder 40 and the second slide surface 23 is called a second slide section and constitutes synchronously rotating means for synchronously rotating the base cylinder 20 and the spiral cylinder 40.

More specifically, it is set such that frictional force is applied to the second slide section in order for the spiral cylinder 40 not to rotate relatively to the base cylinder 20, in other words, so as to have slide resistance required for unification of the spiral cylinder 40 and the base cylinder 20 at the time of feeding operation in which the push rod 30 rises or descends along the spiral cylinder 40. Also, the O-ring 6 gives slide resistance sufficient for preventing the spiral cylinder 40 from rotating relatively to the base cylinder 20 when the push rod 30 is forced to descend by a load pressure which is applied to a stick type cosmetic material while a user of the cosmetic material puts on makeup.

Further, the stopper member 50 is installed at a lower end of the axis section 34, the push rod 30 rises by relative rotations of the front cylinder 10 and the base cylinder 20, and the push rod 30 ceases to rise when the stopper member 50 comes into contact with a lower surface of the spiral cylinder 40. When torque which is large enough to overcome the frictional resistance of the second slide section provided between the spiral cylinder 40 and the base cylinder 20 is furnished for promoting further relative rotations of the front cylinder 10 and the base cylinder 20 at the uppermost limit, the spiral cylinder 40 starts rotating together with the push rod 30. Therefore, a feeding mechanism of the push rod 30 does not function any more and an overload is not applied between the push rod 30 and the spiral cylinder 40.

On the other hand, when the push rod 30 goes down and reaches the lowermost limit, a lower surface of the retaining section 31 comes into contact with an upper surface of the spiral cylinder 40 and the push rod 30 ceases to descend. Also at this time, when large rotary torque is further furnished in such a state, the spiral cylinder 40 starts rotating together with the push rod 30, similarly the feeding mechanism of the push rod 30 does not function any more, and an overload is not applied to the feeding mechanism.

Next, operation of the container for a stick type cosmetic material according to the present invention will be described.

In a state shown in FIG. 1, the push rod 30 is situated at the lowermost limit where a lower end surface of the retaining section 31 comes into contact with an upper surface of the spiral cylinder 40. This is the position which the stick type cosmetic material retreats most.

In this state, when the front cylinder 10 is rotated with respect to the base cylinder 20 in a direction of positive rotation which is a rotational direction of the push rod 30 in progress, the push rod 30 and the front cylinder 10 synchronously rotate due to the rotation regulating mechanism, whereby the push rod 30 rotates relatively to the base cylinder 20.

Since the spiral cylinder 40 which is inserted into the base cylinder 20 unites with the base cylinder 20 due to the synchronously rotating means constituted by the O-ring 6 and the like, the spiral cylinder 40 rotates relatively to the push rod 30 and the feeding mechanism constituted by the spiral engagement mechanism and the rotation regulating mechanism operates. Thus, the push rod 30 advances in the container for a stick type cosmetic material while retaining the stick type cosmetic material.

If the rotation is further continued, a state of the uppermost limit shown in FIG. 2 will be brought about.

At this uppermost limit, a front end surface of the stopper member 50 installed at a rear end of the push rod 30 comes into contact with a rear end surface of the spiral cylinder 40 and the push rod 30 cannot advance any more.

When the front cylinder 10 is rotated in a direction of positive rotation at the uppermost limit so as to feed out the stick type cosmetic material A further, rotary torque for causing the spiral cylinder 40 to rotate with respect to the base cylinder 20 through the push rod 30 which rotates synchronously with the front cylinder 10 is furnished.

When the rotary torque exceeds a certain value, in other words, when rotary torque larger than a value of slide resistance applied by the synchronously rotating means for synchronously rotating the spiral cylinder 40 and the base cylinder 20 is applied to the spiral cylinder 40, the synchronously rotating means are released, and the spiral cylinder 40 is then raced with respect to the base cylinder 20, whereby travel of the push rod 30 is restrained.

Therefore, at the uppermost limit, a shearing stress which arises by twisting the push rod 30 in order for the front cylinder 10 and the spiral cylinder 40 to relatively rotate will never be larger than a value of slide resistance applied by the synchronously rotating means.

When the strength of the push rod 30 is set, since it is possible to previously estimate the maximum shearing stress which will act on the push rod 30 at the uppermost limit, a diameter of the push rod 30 does not have to be larger than it is required. Similarly, it is possible to estimate the required strength and then design the spiral cylinder 40.

More specifically, in this embodiment, even though the front cylinder 10 and the base cylinder 20 are relatively rotated by force more powerful than expected at the uppermost limit when the stick type cosmetic material is fed out, a shearing stress resulting from twisting which applies to the push rod 30 never exceeds a certain value. Thus, even in the container for a stick type cosmetic material having minimum strength required, it is possible to securely prevent the feeding mechanism from breaking.

Next, when the front cylinder 10 is rotated in a direction which is opposite to an advancing direction (an ascending direction) of the push rod 30, in other words, when the front cylinder 10 is caused to make a negative rotation, the base cylinder 20 and the spiral cylinder 40 are synchronously rotated by the synchronously rotating means, in other words, the spiral cylinder 40 rotates relatively to the push rod 30 and the feeding mechanism functions. The push rod 30 then retreats and in due time, a lower end surface of the retaining section 31 comes into contact with an upper end surface of the spiral cylinder 40, whereby a state of the retreat limit as shown in FIG. 1 is brought about.

Even though the front cylinder 10 is caused to make a further negative rotation with respect to the base cylinder 20 at this time, when torque which is applied to the spiral cylinder 40 exceeds a certain value, the synchronously rotating means constituted by the base cylinder 20 and the spiral cylinder 40 are released. Thus, the spiral cylinder 40 is raced, thereby preventing the feeding mechanism from breaking.

Figure 4:
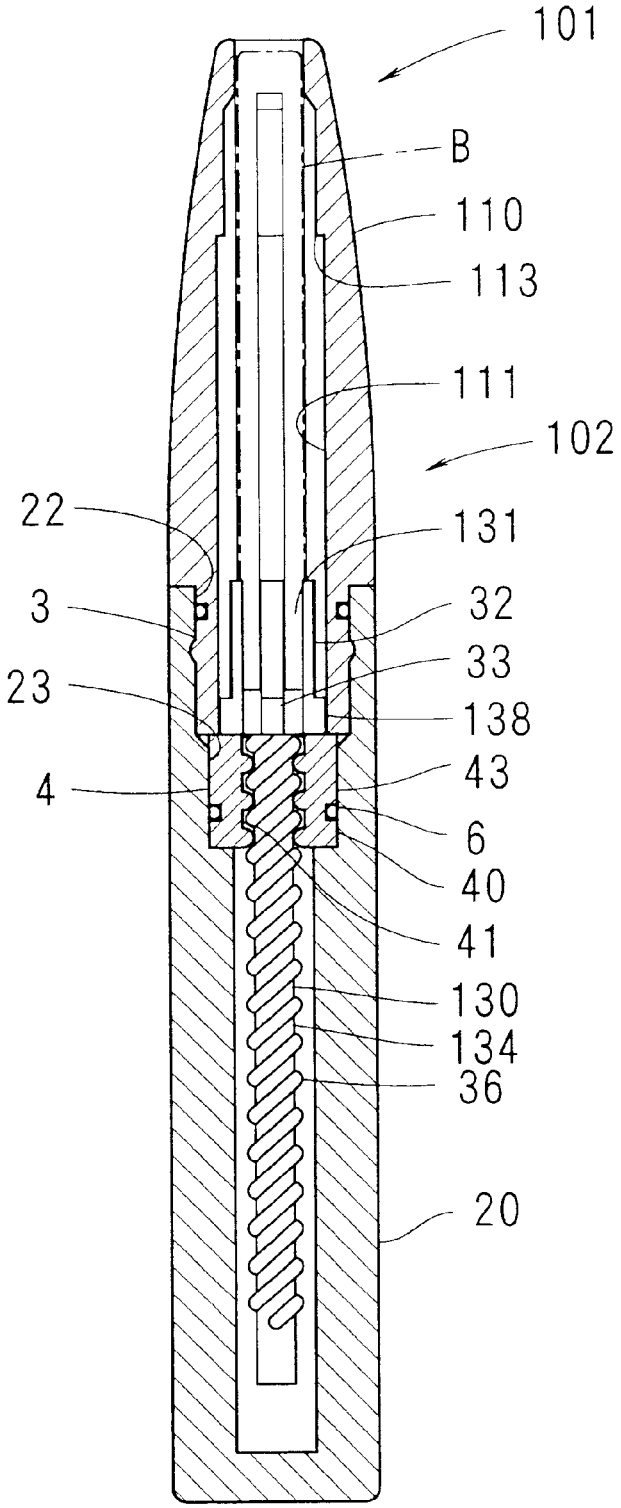
FIG. 4 is a sectional view showing a second embodiment of the present invention.
Figure 5:
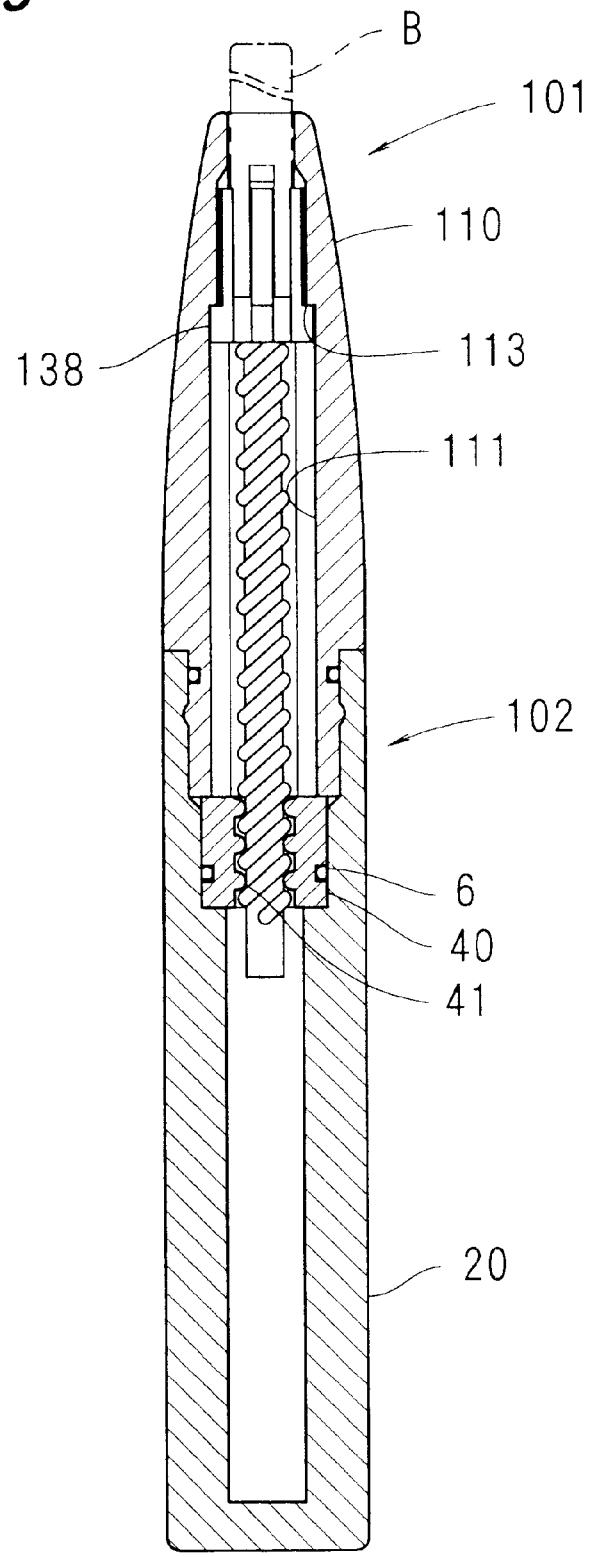
FIG. 5 is a sectional view showing the operating state, similarly.

FIGS. 4 and 5 show the container for a stick type cosmetic material according to a second embodiment of the present invention.

A container for a stick type cosmetic material 101 according to the second embodiment differs from the container for a stick type cosmetic material according to the first embodiment in terminating constitution which defines the uppermost limit. Thus, the container for a stick type cosmetic material 101 does not need a stopper member, but other fundamental constitution is common to both of the containers. Therefore, in FIGS. 4 and 5, identical reference numerals are attached to the components which have the same functions as those of the components shown in FIGS. 1 through 3. Also, the following description will focus on characteristic aspects of this embodiment.

In this embodiment, a front cylinder 110 and a base cylinder 20 are rotatably connected, thereby constituting an outer shell section 102. Instead of providing the stopper member 50 according to the first embodiment, a downward step section 113 is provided at an upper end of a slide groove 111 which is formed on an inner circumferential surface of a front cylinder 110. It is arranged such that at the uppermost limit of the stick type cosmetic material, an upper end surface of a stopper projection 138 which is installed at a retaining section 131 of a push rod 130 and capable of travelling in an axial direction in the slide groove 111 comes into contact with the downward step section 113.

A rotation regulating mechanism according to this embodiment is constituted by engaging claw base section 33 of the push rod 130 with the slide groove 111 formed on an inner circumferential surface of the front cylinder 110 in such a manner that the claw base section 33 can slide in an axial direction, but cannot rotate.

A spiral engagement mechanism is constituted by spirally engaging a male screw section 36 which is formed at an outer circumference of an axial section 134 extended from the retaining section 131 with a female screw section 41 of a spiral cylinder 40. In other words, as a substitute for the projection described above, the spiral male screw section 36 is formed on an outer circumferential surface of the axis section 134 and is spirally engaged with the spiral cylinder 40.

Referring to operation according to the second embodiment, when the front cylinder 110 is rotated with respect to the base cylinder 20 in a positive rotary direction, a feeding mechanism operates similarly to the first embodiment and the push rod 130 retaining a stick type cosmetic material B is fed out. As shown in FIG. 5, in a short time, an upper end surface of the stopper projection 138 of the push rod 130 comes into contact with the downward step section 113 formed at the slide groove 111 of the front cylinder 110, whereby a state of the uppermost limit is brought about.

Even though the front cylinder 110 is caused to make a further positive rotation in such a state of the uppermost limit, synchronously rotating means for synchronously rotating the spiral cylinder 40 and the base cylinder 20 is released and the base cylinder 20 and the spiral cylinder 40 are relatively rotated. Therefore, an excess load is not applied to each part which constitutes the push rod 130 and the feeding mechanism other than a load of slide resistance obtained by the synchronously rotating means.

As described above, when the uppermost limit is constituted by bringing the push rod 130 into contact with an inner circumferential surface of the front cylinder 110, if fit-in of a concave section 21 and a part corresponding to an engagement convex section 12 is not tight for engaging the front cylinder 110 with the base cylinder 20, the front cylinder 110 will be pushed out of the base cylinder 20 due to reaction force resulting from a spiral advance of the push rod 130 at the uppermost limit, whereby the container for a stick type cosmetic material is taken apart. The stronger relative rotations of a male screw and a female screw of the spiral engagement mechanism are, the greater the reaction force becomes.

Therefore, it is necessary to take measures such that a groove of a circular concave section 21, which is formed at the base cylinder 20 and is an undercut section, is made deep or the groove is in such a shape as the front cylinder 110 and the base cylinder are hard to separate. Further, an occurrence of inferior goods, such as a crack of the undercut section at the time of resin molding, is induced, whereby the yield of products is decreased.

However, according to this embodiment, when rotary torque greater than slide resistance applied by the synchronously rotating means is furnished, the synchronously rotating means is released and the feeding mechanism does not function. Therefore, the inconvenience described above can be avoided.

Figure 6:
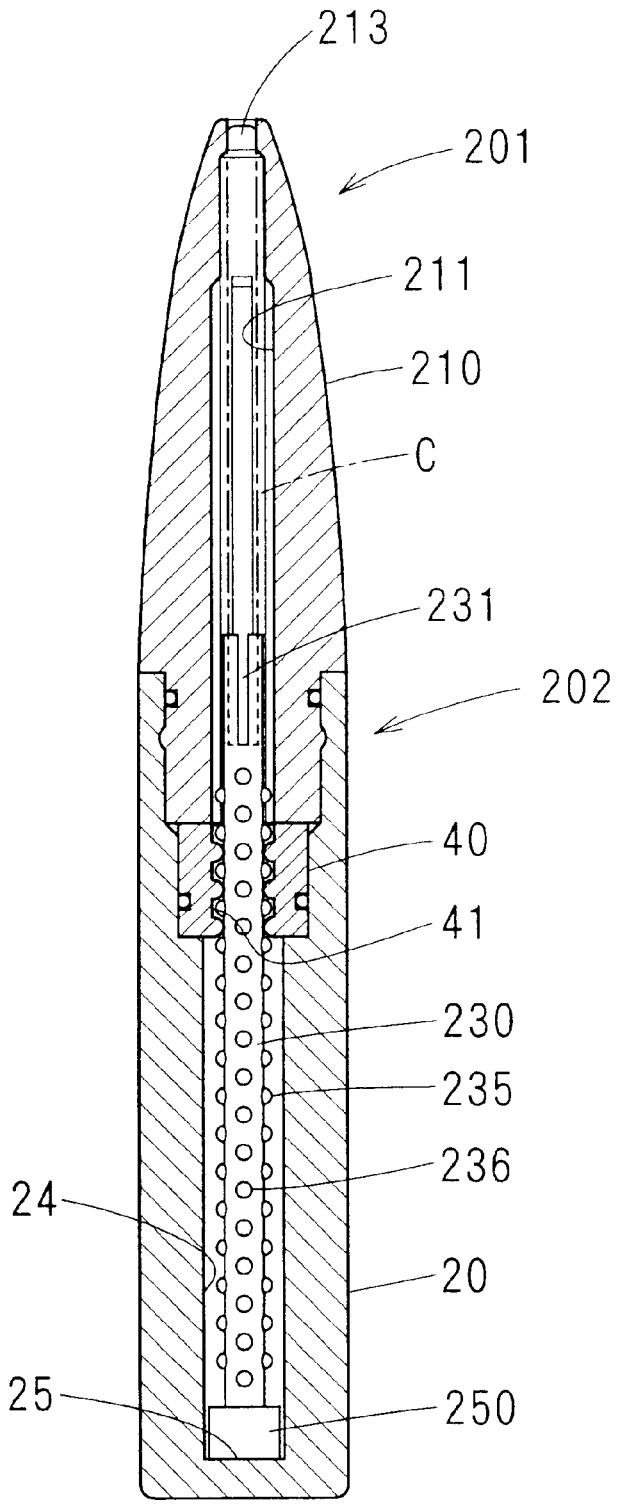
FIG. 6 is a sectional view showing a third embodiment of the present invention.
Figure 7:
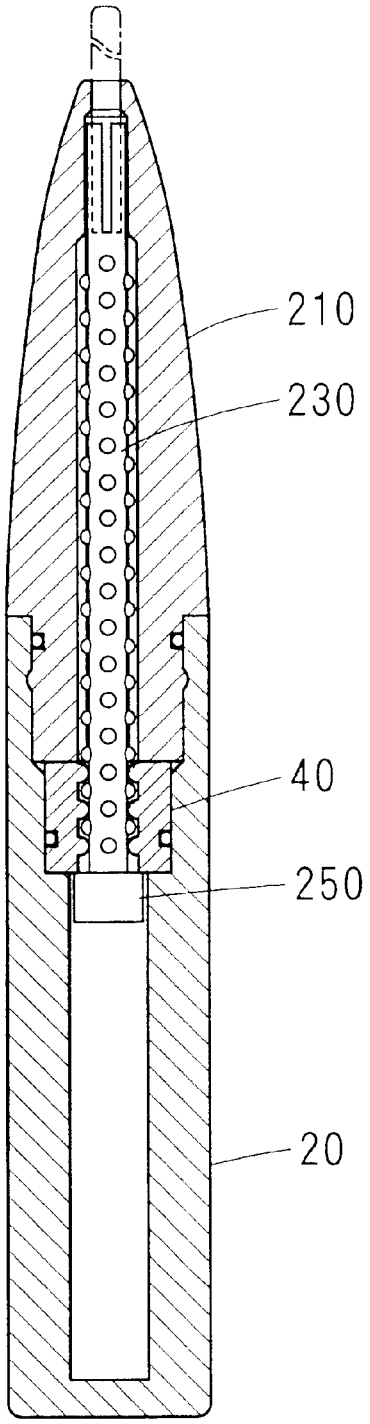
FIG. 7 is a sectional view showing the operating state, similarly.

FIGS. 6 and 7 show a container for a stick type cosmetic material 201 suitable for a thin stick type cosmetic material according to a third embodiment of the present invention.

In this embodiment, a front cylinder 210 and a base cylinder 20 are rotatably connected, thereby constituting an outer shell section 202, and a rotation regulating mechanism and a spiral engagement mechanism which will be described hereinafter are housed therein.

The container for a stick type cosmetic material 201 according to the third embodiment differs from the containers for a stick type cosmetic material 1 and 101 according to the first and second embodiments in the constitution of regulating the lowermost limit of a push rod 230. In the container for a stick type cosmetic material 201 according to the third embodiment, the uppermost limit and the lowermost limit are regulated by a stopper section which is formed as one body with the push rod 230.

Therefore, in FIGS. 6 and 7, identical reference numerals are attached to the components which have the same functions as those of the components shown in FIGS. 1 through 5. Also, the following description will focus on operation at the lowermost limit and shapes of the push rod and the like which are characteristic aspects of this embodiment.

This embodiment is suitable for use of a stick type cosmetic material which has a relatively thin diameter. With respect to a shape of the front cylinder 210, a front end part of a through hole 213 through which the stick type cosmetic material advances and retreats is an opening which has an inside diameter smaller than those of the other parts and supports a side surface of a stick type cosmetic material C when the stick type cosmetic material C is fed out.

The rotation regulating mechanism according to this embodiment is constituted by spline engagement of a projection 235 of the push rod 230 and a slide groove 211 provided on an inner circumferential surface of the front cylinder 210 in such a manner that the projection 235 can slide.

Further, the spiral engagement mechanism is constituted by spiral engagement of a female screw section 41 of a spiral cylinder 40 and the projection 235 arranged on a spiral line of a male screw.

The stopper section 250 comes into contact with a lower end surface of the spiral cylinder 40 at the uppermost limit of the push rod 230, and also the stopper section 250 comes into contact with a bottom surface 25 of an axis hole 24 of the base cylinder 20 at the lowermost limit, thereby terminating a further descent of the push rod 230.

Referring to operation according to the third embodiment, when the front cylinder 210 is rotated with respect to the base cylinder 20 in a positive rotary direction, the feeding mechanism constituted by the rotation regulating mechanism and the spiral engagement mechanism operates and the push rod 230 is fed out while rotating synchronously with the front cylinder 210. As shown in FIG. 7, in a short time, an upper end of the stopper section 250 comes into contact with a lower end of the spiral cylinder 40, whereby a state of the uppermost limit is brought about.

When the front cylinder 210 is rotated in a negative rotary direction opposite to the above for the purposes of feeding down the push rod 230, in a short time a rear end of the push rod 230 comes into contact with the bottom surface 25 of the axis hole 24 of the base cylinder 20, whereby a state of the lowermost limit as shown in FIG. 6 is brought about.

At this time, if torque in the negative rotary direction which is greater than slide resistance of synchronously rotating means (O-ring 6) for synchronously rotating the spiral cylinder 40 and the base cylinder is applied to the push rod 230, the synchronously rotating means will be released and the spiral cylinder 40 and the base cylinder 20 will start relative rotations. Thus, it will be possible to prevent that an overload is applied to the push rod 230 and other parts of the feeding mechanism. Further, although similarly to an occasion that the push rod 230 reaches the uppermost limit according to the second embodiment, a stress to cause the front cylinder 210 to come off the base cylinder 20 arises by pushing up the spiral cylinder 40 by the push rod 230, the stress will never be greater than a value of slide resistance of the synchronously rotating means.

Figure 8:
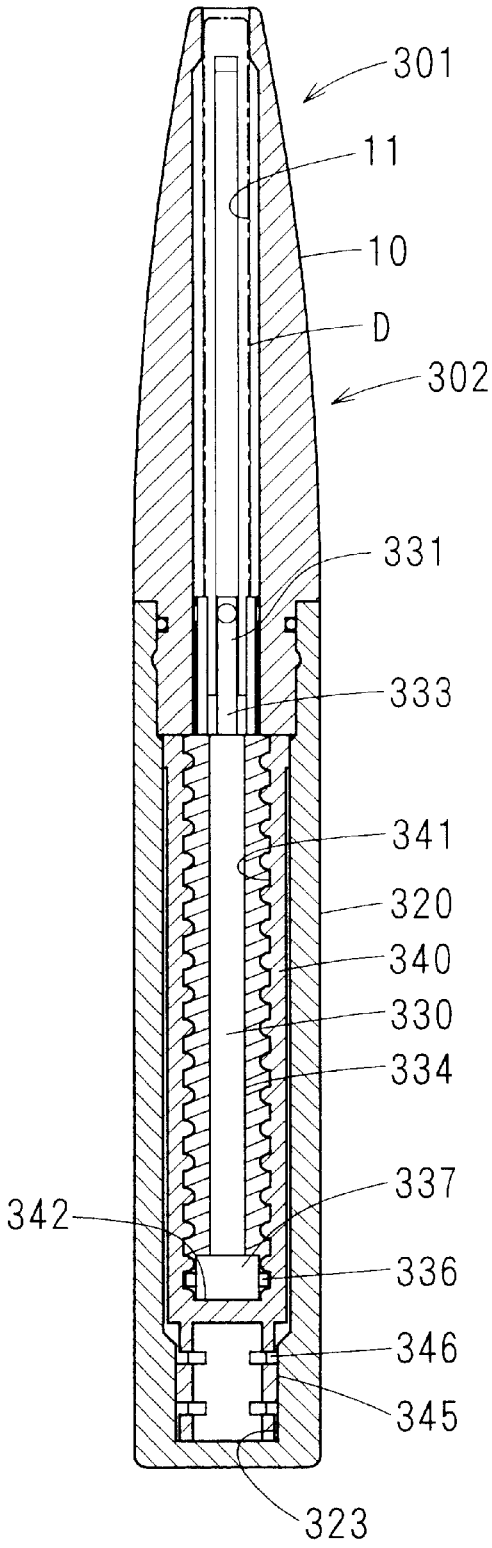
FIG. 8 is a sectional view showing a fourth embodiment of the present invention.
Figure 9:
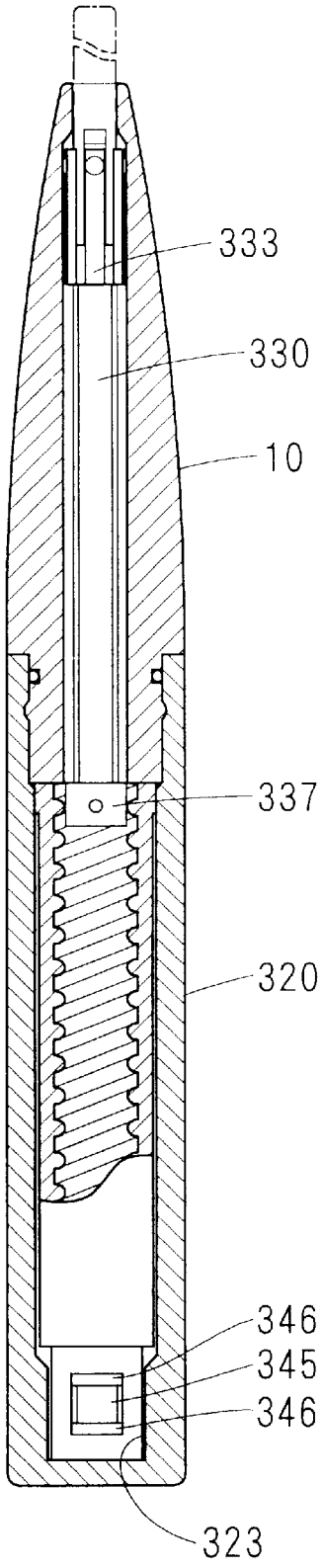
FIG. 9 is a sectional view showing the operating state, similarly.

FIGS. 8 and 9 show a container for a stick type cosmetic material 301 according to a fourth embodiment of the present invention.

The container for a stick type cosmetic material 301 according to the fourth embodiment particularly differs from the container for a stick type cosmetic material 1 according to the first embodiment in the constitution of a push rod 330 and a spiral cylinder 340 which constitute a spiral engagement mechanism and further the constitution of a second slide section for synchronously rotating a base cylinder 320 and the spiral cylinder 340.

Therefore, in this embodiment, identical reference numerals are attached to the components which have the same functions as those of the components shown in FIG. 1. Also, the following description will focus on the second slide section and parts to constitute the spiral engagement mechanism which are characteristic aspects of this embodiment.

In this embodiment, a front cylinder 10 and the base cylinder 320 are rotatably connected, whereby an outer shell section 302 is constituted. In the outer shell section 302, a rotation regulating mechanism and a spiral engagement mechanism which will be described hereinafter are installed.

The rotation regulating mechanism is constituted by engaging a claw base section 333 of the push rod 330 with a slide groove 11 of the front cylinder 10 in such a manner that the claw base section 333 can freely slide.

A retaining section 331 is formed at a front end part of the push rod 330 and a stopper section 337 in a shape of flange is formed at a rear end of an axis section 334 which extends from the retaining section 331. At an outer circumference of the stopper section 337, a male screw section 336 which is short and in a shape of projection is formed.

On the other hand, the long spiral cylinder 340 is formed, a female screw section 341 the length of which corresponds to an effective stroke of the push rod 330 is formed on an inner circumferential surface of the spiral cylinder 340, and the female screw section 341 and the male screw section 336 are spirally engaged, thereby constituting the spiral engagement mechanism.

At a lower end of the long spiral cylinder 340, a slide projection section 345 (a bend section) having slits 346 at the upper and lower parts is formed. The slide projection section 345 comes into contact with a second slide surface 323 which is formed at a lower part of the inner circumference of the base cylinder 320, thereby constituting the second slide section and slide resistance is applied between the spiral cylinder 340 and the base cylinder 320. Thus, synchronously rotating means for synchronously rotating the spiral cylinder 340 and the base cylinder 320 at the time of feeding out the stick type cosmetic material are constituted. Therefore, in this case, it is possible to omit the O-ring described above.

Operation according to the fourth embodiment will be described.

First, when the front cylinder 10 is rotated with respect to the base cylinder 320, the push rod 330 rotates synchronously with the front cylinder 10 because the slide groove 11 and the claw base section 333 are engaged. Further, since the base cylinder 320 and the spiral cylinder 340 are not relatively rotated due to frictional force, the feeding mechanism constituted by the rotary regulating mechanism and the spiral engagement mechanism operates and the push rod 330 advances in a direction of front end of the container for a stick type cosmetic material 301.

In a short time, a front end surface of the stopper section 337 which is provided at a rear end of the push rod 330 comes into contact with a rear end of the front cylinder 10 and reaches the uppermost limit, whereby a state of FIG. 9 is brought about.

If the front cylinder 10 is rotated in a positive rotary direction by force which is greater than a value of the slide resistance set by the second slide section so as to further feed out a stick type cosmetic material D at this time, the synchronously rotating means will be released and the spiral cylinder 340 being united with the push rod 330 will be rotated with respect to the base cylinder 320, thereby preventing stress which applies to the feeding mechanism from becoming greater than a value of slide resistance of the synchronously rotating means.

If the front cylinder 10 is rotated with respect to the base cylinder 320 in a direction of negative rotation, the push rod 330 descends and in a short time a lower end of the stopper section 337 of the push rod 330 will come into contact with a terminal section 342 of the spiral cylinder 340, whereby a state of the lowermost limit shown in FIG. 8 will be brought about. Also at the lowermost limit, if rotary torque greater than the fictional resistance of the second slide section is furnished, the synchronously rotating means will be released, whereby it will be possible to have the same effect as that of the other embodiments.

Figure 10:
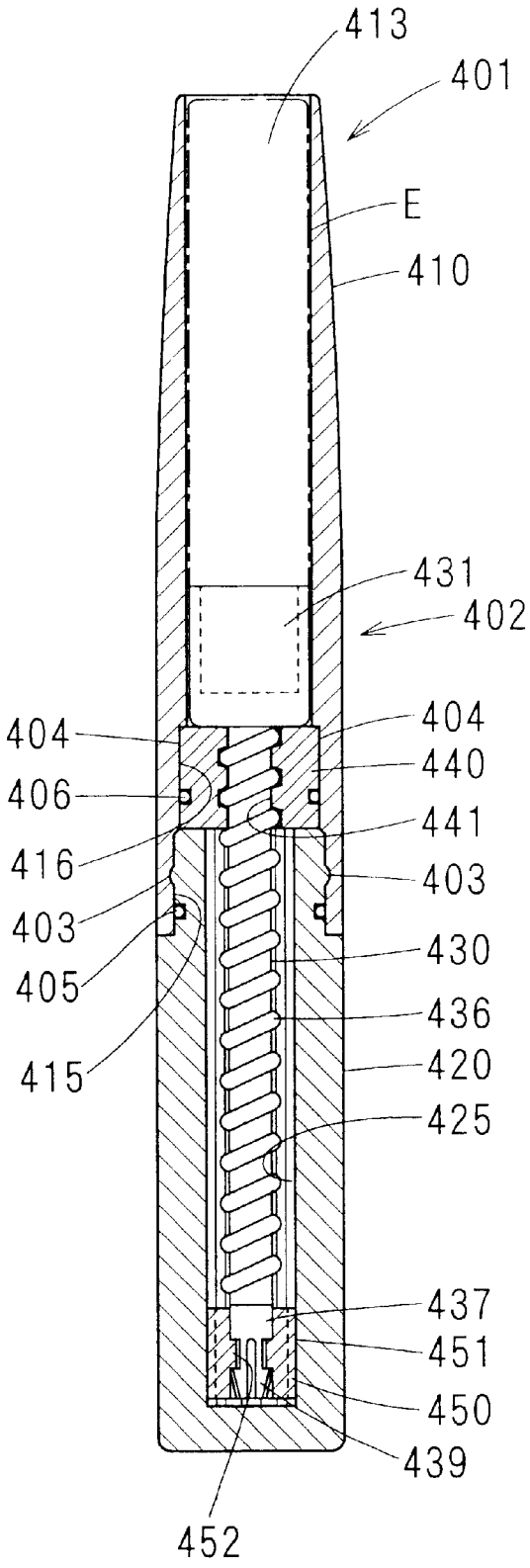
FIG. 10 is a sectional view showing a fifth embodiment of the present invention.
Figure 11:
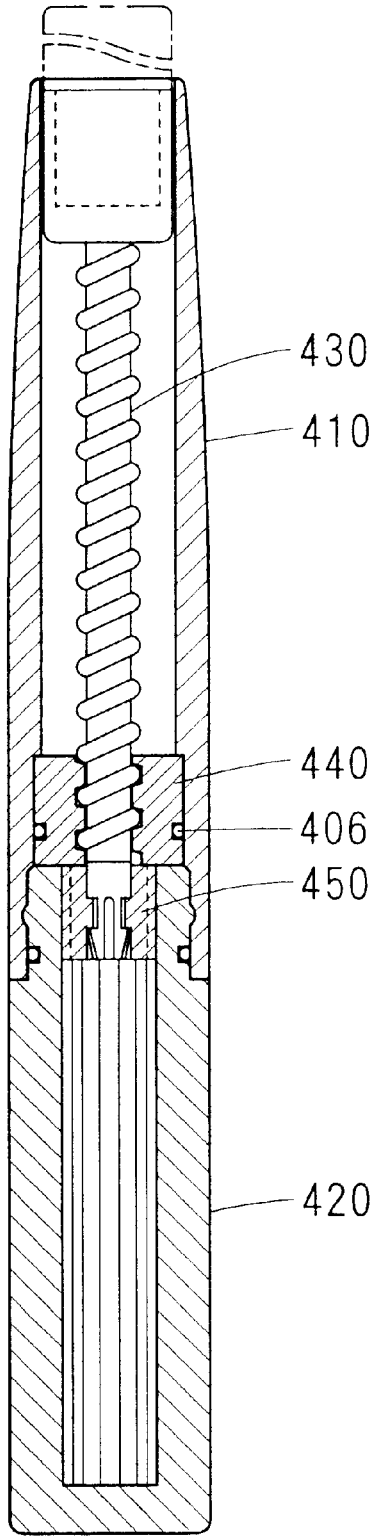
FIG. 11 is a sectional view showing the operating state, similarly.

FIGS. 10 and 11 show a container for a stick type cosmetic material according to a fifth embodiment of the present invention.

A container for a stick type cosmetic material 401 according to the fifth embodiment differs from the other embodiments in that a spiral cylinder 440 and a front cylinder 410 are synchronously rotated and a rotation regulating mechanism is formed between a push rod 430 and a base cylinder 420. In the fifth embodiment, a stick type cosmetic material E rises or descents while rotating with respect to the front cylinder 410.

Therefore, in FIGS. 10 and 11, identical reference numerals are attached to the components which have the same functions as those of the components shown in FIGS. 1 through 3. Also, the following description will focus on a relation between the front cylinder 410 and the spiral cylinder 440 and a relation between the push rod 430 and the base cylinder 420 which are characteristic aspects of the fifth embodiment.

In this embodiment, since a second slide section 404 is provided between the front cylinder 410 and the spiral cylinder 440 and a first slide section 403 is provided below the second slide section 404, it is possible to design a retaining section 431 which is the largest in a relation to the front cylinder 410 as shown in FIG. 10.

This embodiment is suitable for a stick type cosmetic material which is relatively thick. Further, it is not necessary to provide a slide groove as a rotation regulating mechanism in a through hole 413 in which the retaining section 431 of the cosmetic material slides. Thus, this embodiment is also suitable for a filling type container for a stick type cosmetic material in which not a solid cosmetic material, but a melted cosmetic material is filled and molded when a cosmetic material is filled in a container for a cosmetic material.

In this embodiment, a stopper section 437 which is in a shape of approximately board and has a slit section at the center is installed at a rear end of the push rod 430, and bend pieces 439 are installed at the both ends of the slit section.

Since an inner projection section 452 is installed on an inner circumferential surface of a stopper member 450, the bend pieces 439 are engaged with the inner projection section 452 and the stopper member 450 is unrotatably stopped with respect to the push rod 430.

Further, the first slide section 403 for permitting relative rotations of the base cylinder 420 and the front cylinder 410 which constitute an outer shell section 402 is provided in the front cylinder 410.

Further, the spiral cylinder 440 is inserted above the first slide section 403 in an inner circumference of the front cylinder 410 and there is provided the second slide section 404 which serves as the synchronously rotating means for synchronously rotating the spiral cylinder 440 and the front cylinder 410 at the time of feeding out the push rod 430.

In the second slide section 404, slide resistance is given by an O-ring 406 which is installed between a second slide surface 416 provided on an inner circumferential surface of the front cylinder 410 and an outer circumferential surface 443 of the spiral cylinder 440 and the spiral cylinder 440 and the front cylinder 410 are rotated in one united body at the time of feeding out the push rod 430.

Next, the rotation regulating mechanism according to this embodiment is constituted by spline connection of an engagement line section 451 installed on an outer circumferential surface of the stopper member 450 which rotates synchronously with the push rod 430 and an engagement groove 425 installed on an inner circumferential surface of an axis hole of the base cylinder 420 in such a manner that the engagement line section 451 and the engagement groove 425 cannot rotate, but can slide.

Further, a spiral engagement mechanism is constituted by spiral engagement of a female screw section 441 provided at an inner circumference of the spiral cylinder 440 and a male screw section 436 of the push rod 430.

Operation according to this embodiment will be described.

In this embodiment, when the front cylinder 410 which constitutes the outer shell section 402 and the base cylinder 420 are relatively rotated, the push rod 430 inserted rotates synchronously with the base cylinder 420 by the rotation regulating mechanism through the stopper member 450.

Since the front cylinder 410 and the spiral cylinder 440 are synchronously rotated by the synchronously rotating means, finally the push rod 430 and the spiral cylinder 440 which constitute the spiral engagement mechanism relatively rotate. Thus, a feeding mechanism operates and the push rod 430 is fed out, and a stick type cosmetic material E which is retained by the retaining section 431 provided at a front end of the push rod 430 is fed out headed by its front end while rotating with respect to the front cylinder 410. When an upper end of the stopper member 450 comes into contact with a lower end of the spiral cylinder 440 as shown in FIG. 11, a state of the uppermost limit is brought about.

If the stick type cosmetic material E is further rotated in a direction of rise at this time by torque which is larger than slide resistance given by the O-ring 406, the synchronously rotating means will be released similarly to the embodiments described above. It will be possible to prevent the stopper section 437 of the push rod 430 to stop the stopper member 450 at this time and the feeding mechanism of the container for a stick type cosmetic material 401 from being broken.

Next, if the front cylinder 410 is relatively rotated with respect to the base cylinder 420 in a direction that the push rod 430 descends, the push rod 430 will descend and in a short time a state of the lowermost limit as shown in FIG. 10 will be brought about. If the front cylinder 410 is caused to make a further relative rotation in the same direction at this time, the synchronously rotating means will be released, thereby preventing the feeding mechanism from being broken.

Figure 12:
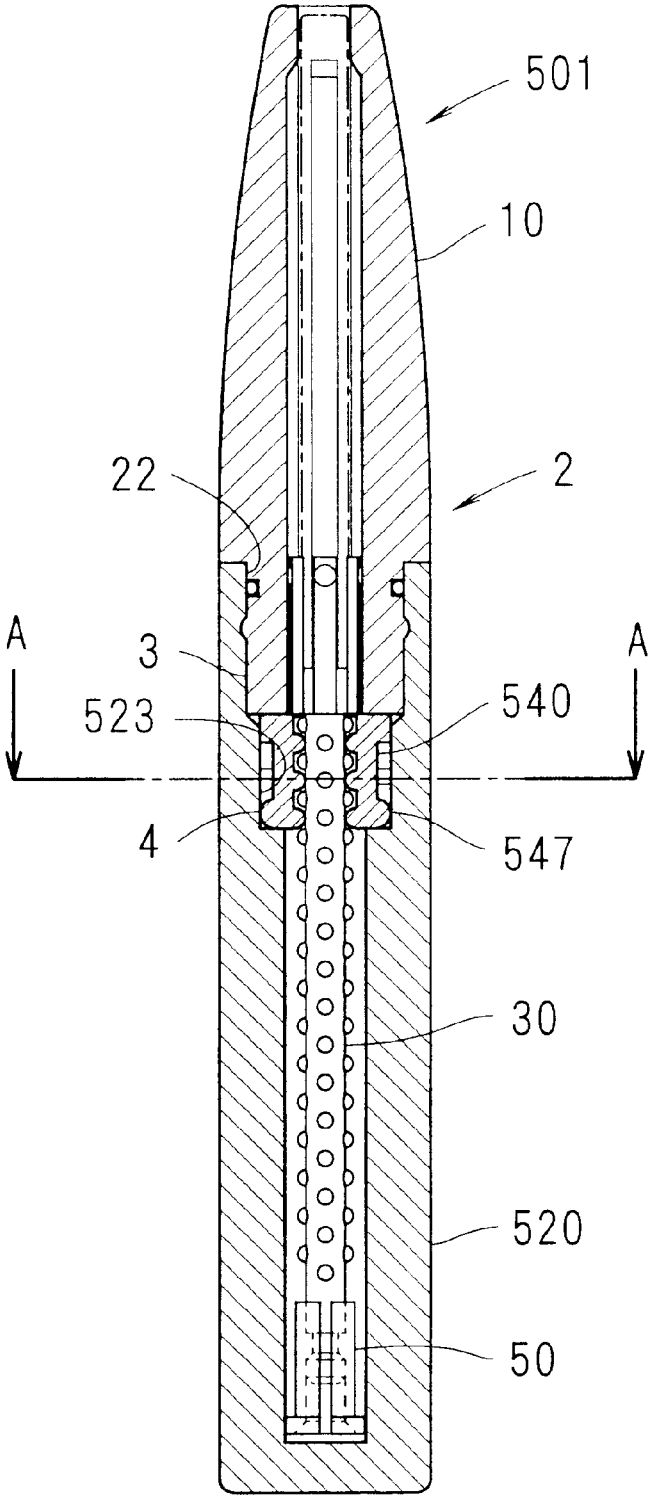
FIG. 12 is a sectional view showing a sixth embodiment of the present invention.
Figure 13:
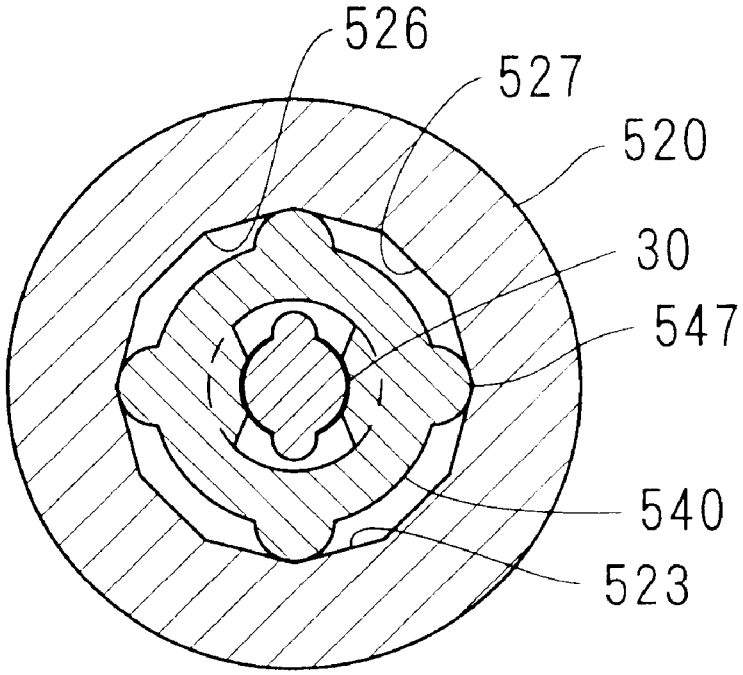
FIG. 13 is a sectional view taken along line A—A of FIG. 12.

FIGS. 12 and 13 show a container for a stick type cosmetic material according to a sixth embodiment of the present invention.

A container for a stick type cosmetic material 501 according to the sixth embodiment differs from the container for a stick type cosmetic material 1 according to the first embodiment in that a sectional form of a second slide surface 523 in which a spiral cylinder 540 is inserted, which constitutes a second slide section, and which is formed on an inner circumferential surface of a base cylinder 520 is polygonal. Further, by taking advantage of the structure that a distance from the center axis of the container for a stick type cosmetic material 501 to a corner 526 of the second slide surface 523 is longest and a distance from the center axis of the container for a stick type cosmetic material 501 to the center of a side 527 is shortest, resistance which arises when a slide projection 547 installed at an outer circumference of the spiral cylinder 540 goes over a central part of the side 527 is rendered to be slide resistance. This is the characteristics of the container for a stick type cosmetic material 501.

Therefore, in FIGS. 12 and 13, identical reference numerals are attached to the components which have the same functions as those of the components shown in FIGS. 1 through 3.

The second slide surface 523 whose sectional form is polygonal is provided on an inner circumferential surface of the base cylinder 520. The slide projection 547 formed at an outer circumference of the spiral cylinder 540 is stopped at the corner 526 of the second slide surface 523, thereby constituting synchronously rotating means. At this time, a value of the slide resistance is a value of resistance which arises when the slide projection 547 goes over the central part of the side 527.

Since the constitution is as described above, in this embodiment, an O-ring is not required and further it is possible for a user to feel a sensation of being caught (a sensation of click) when the slide projection 547 travels along the side 527. Thus, it is possible to clearly notify the user of the uppermost limit or the like.

In the present invention, an outer shell section is constituted by a front cylinder and a base cylinder and an outward appearance is formed by the both cylindrical bodies. However, the present invention is not restricted to it. It is also justifiable to provide a cartridge type container for a stick type cosmetic material in which, for example, only a front cylinder forms the outward appearance, also an engagement section is installed at a rear end of the base cylinder, and a container body that is engaged with the engagement section and rotates synchronously with the base cylinder is provided.

More specifically, in the present invention, it will be sufficient if two cylindrical bodies which are connected with each other and can relatively rotate constitute the outer shell section. Further, a spiral cylinder which is a third cylindrical body is inserted in the outer shell section, whereby a feeding mechanism is constituted. Therefore, the present invention is applicable to various aspects and it can also be applied to the cartridge type container for a stick type cosmetic material as described above.

Further, the front cylinder (first cylindrical body) and the base cylinder (second cylindrical body) which constitute the outer shell section according to the present invention are formed using a single member in the embodiments. However, the present invention is not restricted to it. It goes without saying that, for example, the base cylinder (second cylindrical body) may be formed using a plurality of members.

The present invention is not restricted to the embodiments described above. It is obvious that various modifications can be made within a scope of technical ideas which are set forth in claims.

What is claimed is:

1. A container for a stick type cosmetic material having a mechanism for feeding the stick type cosmetic material, said container comprising:

a front cylinder;

a base cylinder which can be connected with the front cylinder;

an outer shell section which is constituted by coaxially and rotatably connecting the front cylinder and the base cylinder;

a travelling section installed in the outer shell section, the travelling section having a retaining section for retaining the stick type cosmetic material and travelling in an axial direction in the outer shell section;

a rotation regulating mechanism which allows the travelling section only to relatively slide in an axial direction with respect to one of the front cylinder and the base cylinder which constitute the outer shell section;

a spiral cylinder which has a female screw section to be spirally engaged with a male screw section installed at the travelling section;

a spiral engagement mechanism which is constituted by spiral engagement of the male screw section and the female screw section;

synchronously rotating means for rotating, by slide resistance, the spiral cylinder synchronously with the other one of the front cylinder and the base cylinder which constitute the outer shell section; and travel regulating means for regulating travel of the travelling section at its travelling limit in the outer shell section, wherein when the front cylinder and the base cylinder are relatively rotated, the travelling section is fed out by the feeding mechanism, and when rotary torque which causes the front cylinder and the base cylinder to relatively rotate when the travelling section reaches an uppermost limit exceeds a value of the slide resistance of the synchronously rotating means, the synchronously rotating means are released and the spiral cylinder and the male screw section are synchronously rotated.

2. A container for a stick type cosmetic material according to claim 1, wherein the rotation regulating mechanism is provided between the front cylinder and the travelling section, and the synchronously rotating means are provided between the base cylinder and the spiral cylinder.

3. A container for a stick type cosmetic material according to claim 2, wherein the synchronously rotating means are O-rings which lie between the base cylinder and the spiral cylinder.

4. A container for a stick type cosmetic material according to claim 1, wherein the rotation regulating mechanism is provided between the base cylinder and the travelling section, and the synchronously rotating means are provided between the front cylinder and the spiral cylinder.

5. A container for a stick type cosmetic material according to claim 4, wherein the synchronously rotating means are O-rings which lie between the front cylinder and the spiral cylinder.

6. A container for a stick type cosmetic material according to claim 1, wherein the travel regulating means are constituted by a stopper member provided at the travelling section and a contact member of the outer shell section which the stopper member comes into contact with at an uppermost limit or a lowermost limit of the travelling section.

* * * * *